United States Patent [19]

Pink

[11] Patent Number: 4,678,247

[45] Date of Patent: Jul. 7, 1987

[54] REFRIGERATOR SHELF FOR DISPENSING CANS OR THAWING FOOD

[75] Inventor: John J. Pink, Cedar Rapids, Iowa

[73] Assignee: Amana Refrigeration, Inc., Amana, Iowa

[21] Appl. No.: 811,224

[22] Filed: Dec. 20, 1985

[51] Int. Cl.[4] ..... A47F 3/04

[52] U.S. Cl. ..... 312/116; 62/441

[58] Field of Search ..... 220/467; 312/116, 117, 312/132, 313, 119, 126; 62/440, 441, 447

[56] References Cited

U.S. PATENT DOCUMENTS 4,528,825 7/1985 Khan ..... 312/313

*Primary Examiner*—Henry A. Bennett

*Attorney, Agent, or Firm*—William R. Clark; Richard M. Sharkansky

[57] ABSTRACT

A refrigerator shelf for dispensing cans or thawing food. Adapted for mounting in the limited height space below a meat keeper, the shelf defines a one-legged tray which is supported by the cross members of a cantilever-suspended frame. The cross bars are substantially L-shaped and inverted such that the respective supporting short sides are at different vertical heights. When the legged end of the tray is forward, the tray is held horizontally. When the legged end of the tray is rearward, the tray functions as a front loading can dispenser because it is inclined towards the rear.

10 Claims, 13 Drawing Figures

FIG. 1
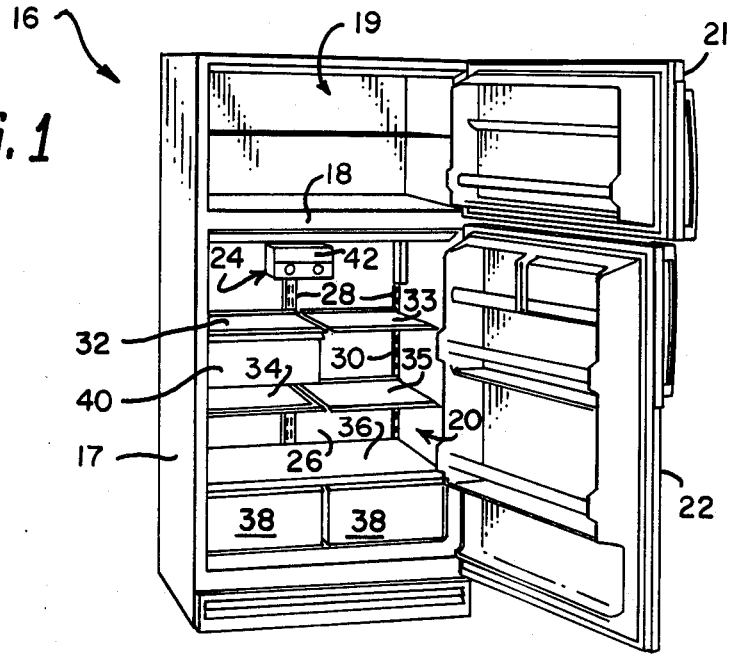
FIG. 8
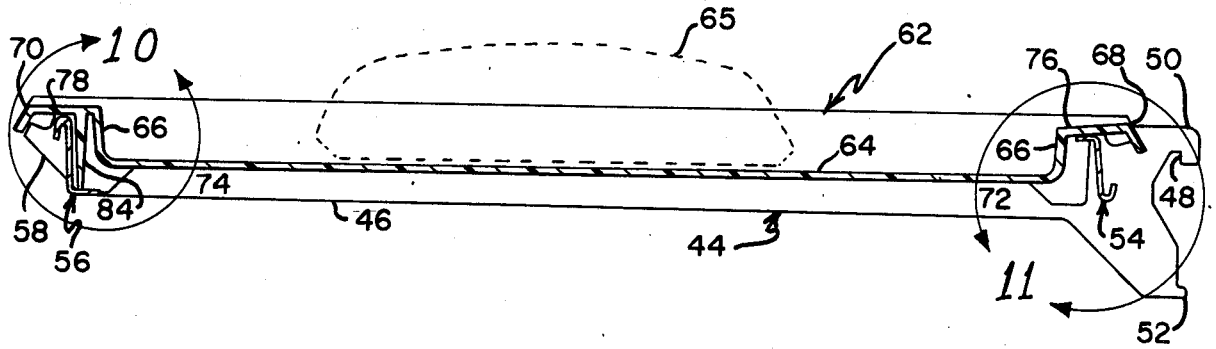
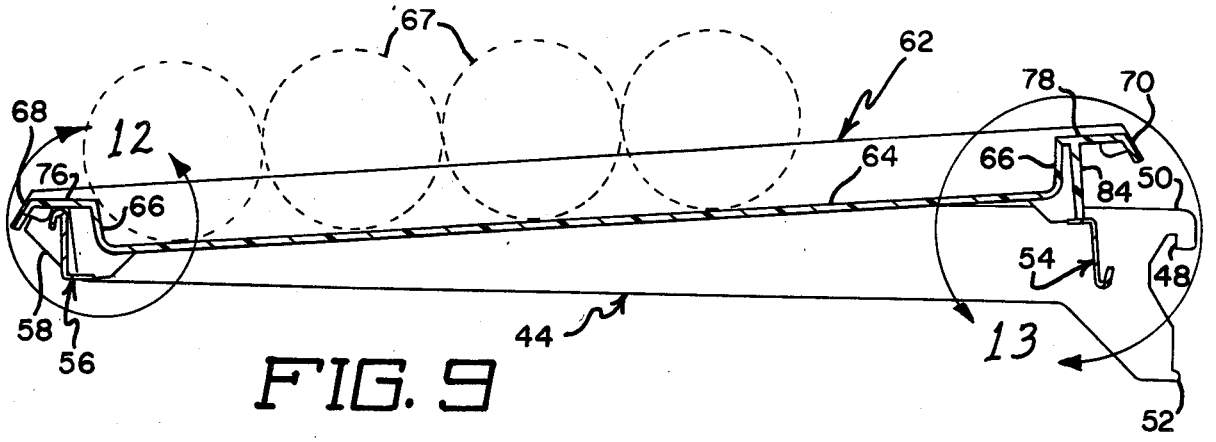
FIG. 9

FIG. 4
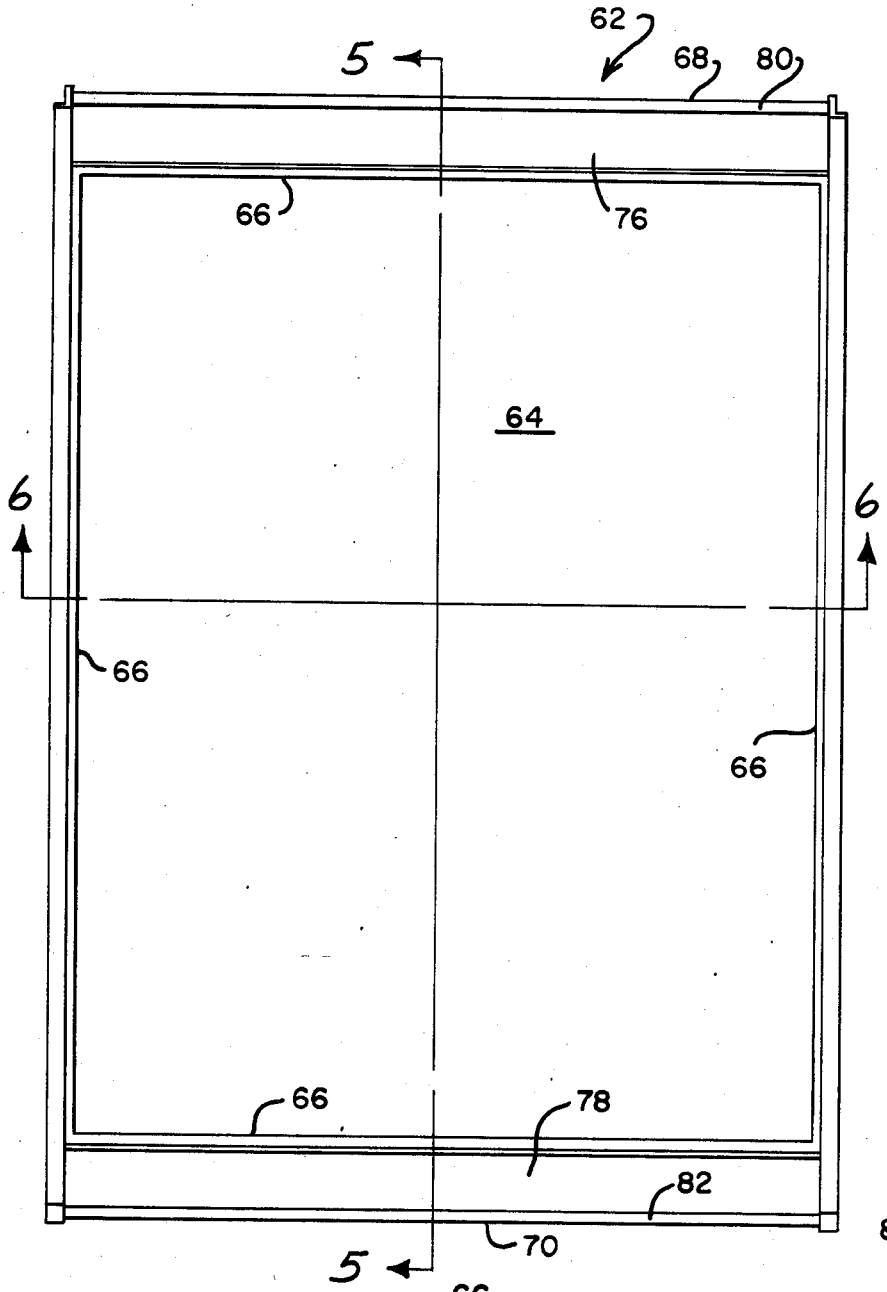
FIG. 5
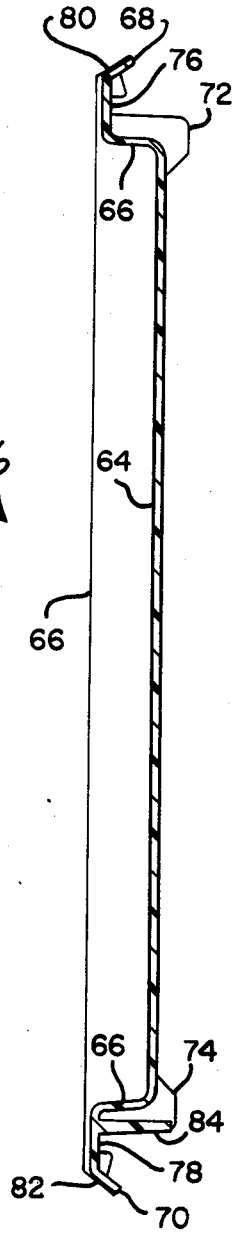
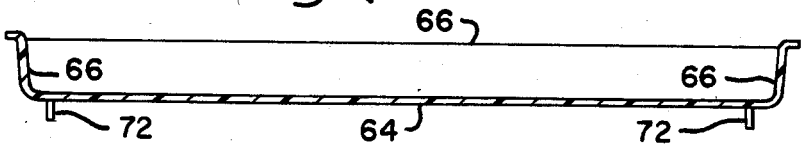
FIG. 6
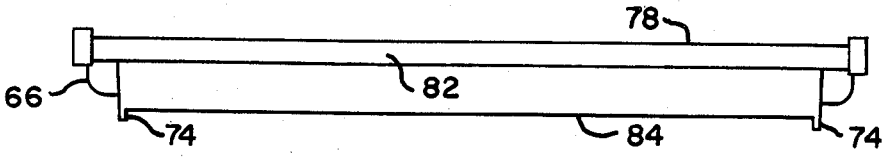
FIG. 7

FIG. 10
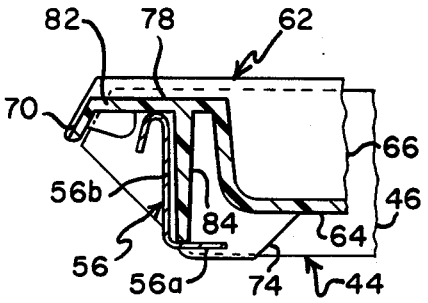
FIG. 11
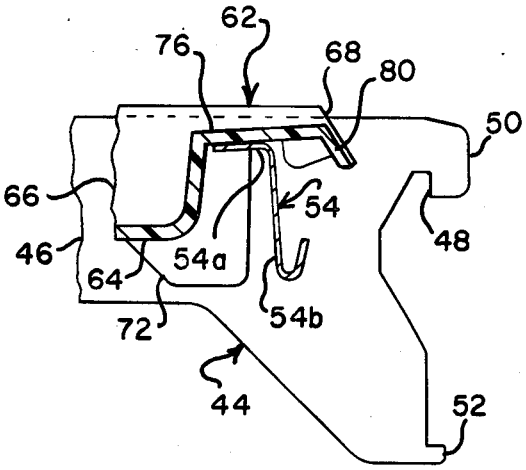
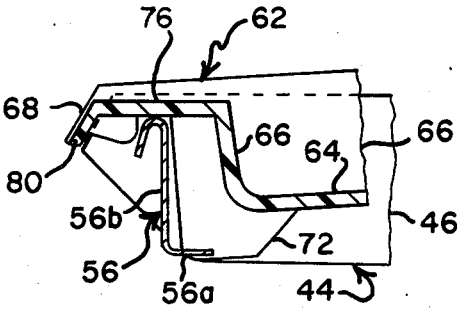
FIG. 12
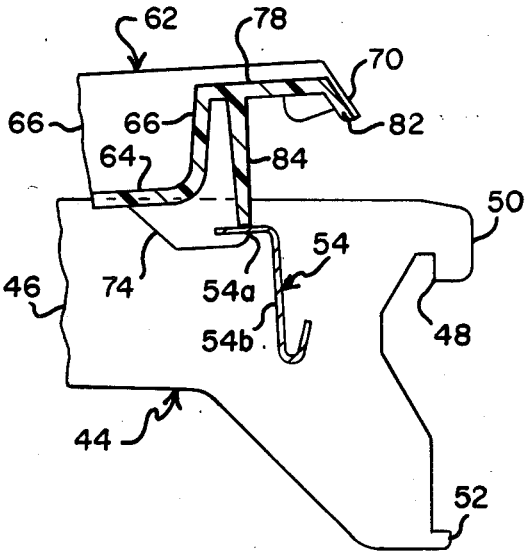
FIG. 13

REFRIGERATOR SHELF FOR DISPENSING CANS OR THAWING FOOD

BACKGROUND OF THE INVENTION

As is well known, meat keepers are used in refrigerators to preserve meat at an optimum temperature which is generally 5°-8° F. cooler than the rest of the refrigerated food compartment. More specifically, meat keepers preferably maintain meat at a temperature just slightly above the freezing temperature of water. In its most common form, a meat keeper defines a slide-out drawer that is approximately half the width of the refrigerated food compartment and is suspended under the top shelf of the refrigerator for convenient access. A significant disadvantage of this configuration is that if the top two shelves extend the entire width of the refrigerated food compartment, then the portion of the second shelf below the meat keeper is restricted in height. Accordingly, the space below the meat keeper is not very usable because access to the back of the second shelf is very difficult.

SUMMARY OF THE INVENTION

It is an object of the invention to effectively utilize a low profile space in a refrigerator.

It is a further object of the invention to provide use for the rear portion of the low profile region below a meat keeper in a refrigerator.

Also, it is an object to provide a shelf on which foods such as meats can be defrosted without the juices dripping to other parts of the refrigerator.

Further, it is an object to provide a can dispenser for the space below a meat keeper or other apparatus that restricts shelf height. It is a further object that the cans be accessible from the front of the refrigerator.

Another object is to provide an apparatus that, depending on its operating position, has a horizontal support surface with sides for defrosting meat or has an inclined support surface for loading and dispensing cans from the front in a low profile region.

These and other objects are provided in accordance with the invention which defines a food thawing and can dispensing apparatus for a refrigerator, comprising a tray having a bottom and raised sides, means for supporting the tray in the refrigerator, and the tray comprising means engageable with the support means for holding the bottom horizontally in a first position of the tray with respect to the support means and for holding the bottom inclined in a second position of the tray with respect to the support means wherein, in the first position, the tray is adapted for supporting thawing foods and wherein, in the second position, the tray is adapted for storing cans rollably disposed towards the front of the refrigerator on the inclined bottom. It may be preferable that the supporting means comprise a cantilever-suspended frame. Also, the holding means may comprise a leg extending downwardly from the tray at one end thereof.

The invention may also be practiced by a food thawing and can dispensing apparatus for a refrigerator, comprising a tray having a bottom and raised sides, means for supporting the tray in a refrigerator, and the tray comprising a downwardly extending lateral leg at one end thereof, said leg being seatable on the supporting means in a first position of said tray with respect to supporting means for holding the bottom horizontally, the leg further being seatable on the supporting means in a second position of the tray with respect to the supporting means for holding the bottom at an incline wherein, in said second position, said tray is adapted for storing cans rollably disposed towards the front of the refrigerator. It may be preferable that the supporting means comprise a frame suspended cantileverly in the refrigerator. Also, the first and second positions may be reversed approximately 180° from each other in a horizontal plane.

The invention further defines a refrigerator shelf comprising a substantially rectangular tray comprising a bottom and raised sides, a frame for supporting the tray, the frame having a pair of side members interconnected by cross members, and the tray further comprising means engageable with the frame for holding the bottom of the tray horizontally when a first side of the tray is forward in the refrigerator and for holding the bottom of the tray at an incline towards the rear when the opposite side of the first side of the tray is forward in the refrigerator. The holding means may comprise a lateral leg extending downwardly from the first side of the tray. Also, the cross members may be substantially L-shaped with the back cross member being inverted from the front cross member.

The invention further defines a refrigerator shelf comprising a tray comprising a substantially rectangular bottom panel and a raised peripheral wall, a frame for supporting the tray, the frame having a pair of parallel cantilever-supported side members with front and back cross members connected therebetween, and the tray comprising means engageable with the back cross member in a first position of the tray for holding the bottom panel with a rearward incline wherein rollable objects supported by the panel are disposed to roll toward the front of the refrigerator, the holding means being engageable with the front cross member in a second position of the tray for supporting the bottom panel horizontally.

The invention may also be practiced by a refrigerator shelf comprising a tray comprising a substantially rectangular bottom panel having a raised peripheral wall with a lip, a frame for supporting the tray, the tray having a pair of parallel side members adapted for being cantilever-supported in the refrigerator, the frame further comprising a substantially L-shaped front cross member and a substantially inverted L-shaped back cross member interconnected between the parallel side members, and the tray further comprising a leg extending downwardly from the lip on one side of the tray wherein when the leg side of the tray is at the rear of the refrigerator, the leg engages the top of the back cross member elevating the rear of the tray to provide a rearward incline of the bottom panel and, when the leg side of the tray is toward the front of the refrigerator, the leg seats on the bottom portion of the front cross member thereby supporting the panel in a substantially horizontal position.

BRIEF DESCRIPTION OF THE DRAWINGS

The foregoing objects and advantages of the invention will be more fully understood by reading the Description of the Preferred Embodiment with reference to the drawings wherein:

FIG. 1 is a front perspective view of a refrigerator;

FIG. 4 is a top view of the tray;

FIG. 5 is a view taken along line 5—5 of FIG. 4;

FIG. 6 is a view taken along line 6—6 of FIG. 4;

FIG. 7 is a front view of the tray of FIG. 4;

FIG. 8 is a sectioned side view of the tray supported on the cantilever frame in the food thawing position;

FIG. 9 is a side sectioned view of the tray supported on the frame in a can dispensing position;

FIG. 10 is an expanded view of circle 10 of FIG. 8;

FIG. 11 is an expanded view of circle 11 of FIG. 8;

FIG. 12 is an expanded view of circle 12 of FIG. 9; and

FIG. 13 is an expanded view of circle 13 of FIG. 9.

DESCRIPTION OF THE PREFERRED EMBODIMENT

Figure 2:
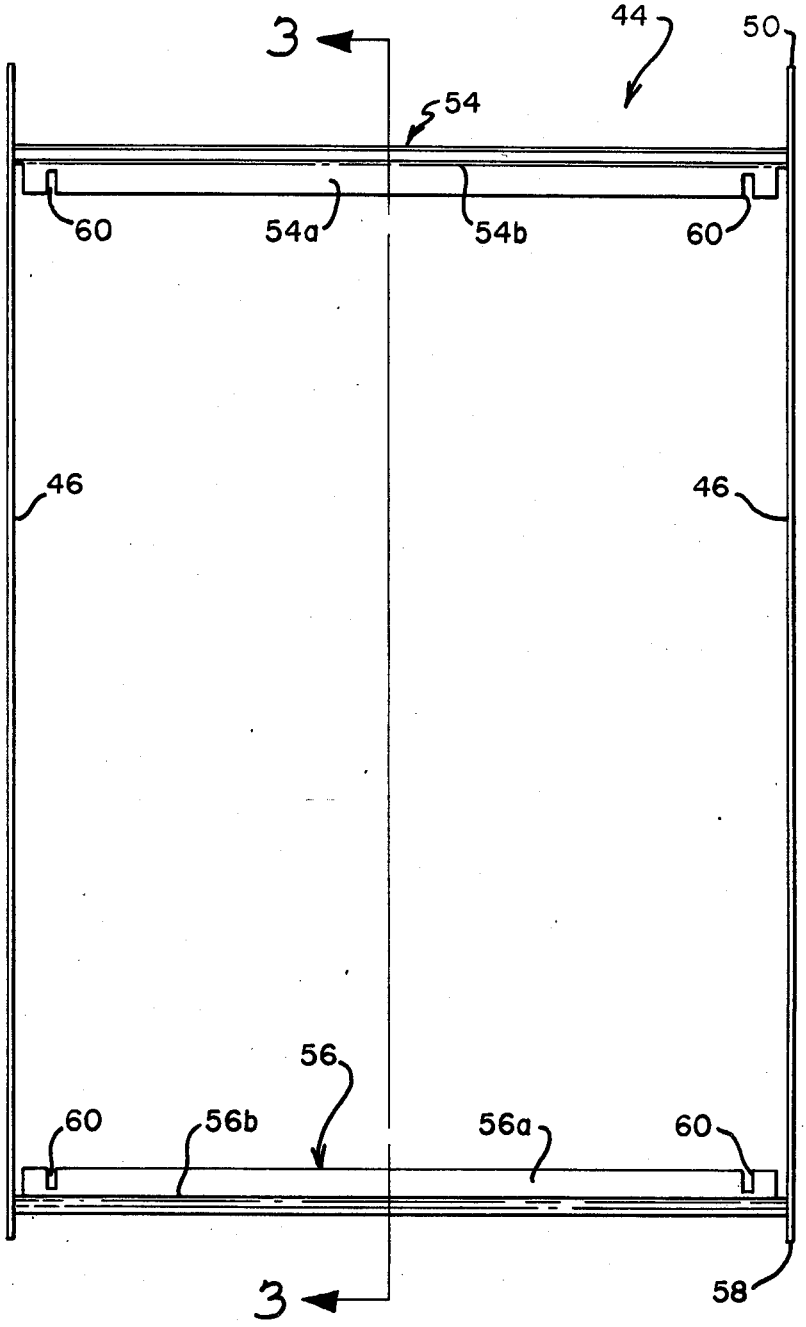
FIG. 2 is a top view of a cantilever support frame.

Referring to FIG. 1, there is shown refrigerator 16 using the invention to advantage. Although many other types of refrigerators could be used, refrigerator 16 is here shown as a "top mount" refrigerator defined by the cabinet 17 being divided by horizontal partition 18 into a top freezer compartment 19 and a lower refrigerator food compartment 20. Door 21 closes freezer compartment 19 and door 22 closes refrigerated food compartment 20. Temperature control box 24 on back wall 26 of refrigerated food compartment 20 is used to adjust the operating temperature of the refrigerated food compartment 20. The underside of temperature control box 24 may also provide a cold air inlet into refrigerated food compartment 20.

Still referring to FIG. 1, a plurality of shelf support tracks 28 are vertically mounted along back wall 26 of refrigerated food compartment 20. In a well known manner, tracks 28 have slots 30 into which shelves 32–36 mount in cantilever fashion. Below shelf 36 may be two crisper pans 38. Connected to the underside of shelf 32 is meat keeper 40 which may be controlled by slide gate 42 on temperature control box 24. With the exception of shelf 34 which will be described in detail herein in accordance with the invention, the parts described heretofore are conventional. For a more detailed description of these conventional parts, see U.S. Pat. No. 4,539,819, which is hereby incorporated by reference.

Figure 3:
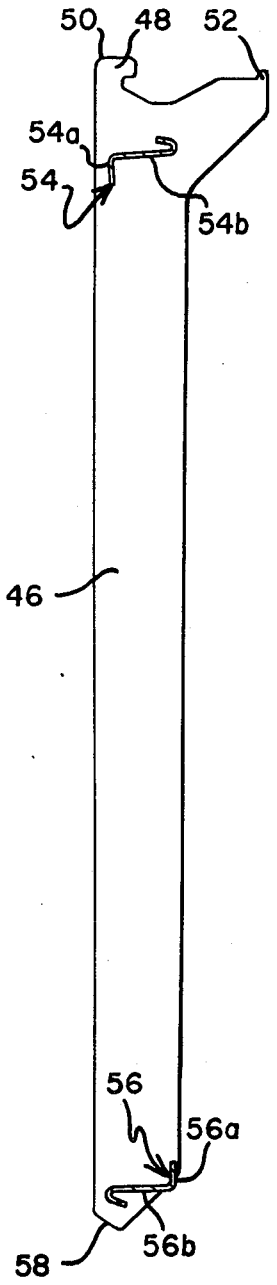
FIG. 3 is a view taken along line 3—3 of FIG. 2.

Referring to FIG. 2, there is shown a top view of a support frame 44 adapted for cantilever suspension from shelf support tracks 28. FIG. 3 is a view taken along line 3—3 of FIG. 2. Support frame 44 has a parallel pair of opposing longitudinally extending metal frame side members 46 or brackets which have hooks 48 at the back ends 50 which insert in slots 30 of shelf support tracks 28, respectively. Bosses 52 below hooks 48 insert in lower slots 30 to securely and rigidly hold side members 46 in a substantially horizontal plane in cantilever fashion. A back cross bar 54 connects between side members 46 near back ends 50 while front cross bar 56 connects near the front ends 58 of side members 46. As can be seen best in FIG. 3, front and back cross bars 54 and 56 have the same shape except that they are inverted with respect to each other. More specifically, cross bars 54 and 56 are substantially L-shaped and each includes a short leg 54*a* or 56*a* connected to a long leg 54*b* or 56*b* with the distal end bent back. Front cross bar 56 faces rearwardly with its short leg 56*a* on the bottom while back cross bar 54 faces frontwardly with its short leg 54*a* on the top. Each of the short legs 54*a* and 56*a* of back and front cross bars 54 and 56 have a pair of notches 60 adjacent to side members 46.

Referring to FIG. 4, there is shown a top view of tray 62. FIG. 5 is a view taken along line 5—5 of FIG. 4. FIG. 6 is a view taken along line 6—6 of FIG. 4. FIG. 7 is a front view of the tray 62 of FIG. 4; as will be described in detail later herein, the front of tray 62 may be positioned to the rear of refrigerated food compartment 20 in one operative position. Tray 62, which may preferably be molded plastic, has a substantially rectangular bottom 64 or bottom panel on which objects are to be supported. Surrounding the periphery of bottom 64 are raised sides 66. Extending downwardly from the underside of bottom 64 near its longitudinal ends 68 and 70 are respective pairs of blades 72 and 74 or projections which are spaced so as to align with or coincide with notches 60 of support frame 44. Also at the longitudinal ends 68 and 70 are rims 76 and 78 extending to handles 80 and 82, respectively. Rim 78 has a lateral leg 84 extending downwardly while rim 76 does not have a corresponding leg.

In accordance with the invention, support frame 44 is mounted from shelf support tracks 28 in refrigerated food compartment 20 and supports tray 62 to define a shelf 34. Although support frame 44 could be mounted in various positions from shelf support tracks 28 so as to define shelves 32, 33, 35, or 36, particular advantage is achieved by mounting it in the position of shelf 34 below meat keeper 40 as shown in FIG. 1. More specifically, shelf 34, in accordance with the invention, has particular advantage in a low profile region such as below a meat keeper where access to the rear of the shelf 34 is significantly restricted.

Referring to FIGS. 8 and 9, alternate support positions of tray 62 on support frame 44 are shown. FIGS. 10–13 respectively show expanded views of the engagement region between tray 62 and support frame 44, as indicated. In the first tray position as shown in FIG. 8, longitudinal end 70 of tray 62 with leg 84 is to the front of refrigerated food compartment 20. In this position, pairs of blades 72 and 74, respectively, insert in notches 60 to prevent lateral movement of tray 62 with respect to support frame 44, leg 84 seats on short leg 56*a* of front cross bar 56, and rim 76 seats on the inverted short leg 54*a* of back cross bar 54. As can be seen, in this position, the bottom 64 of tray 62 is substantially horizontal. This position has significant advantage for defrosting frozen foods 65 such as meat which have been taken out of top freezer compartment 19. Because tray 62 has raised sides 66, juices coming from the thawing food 65 are prevented from running off shelf 34 onto other surfaces of the refrigerated food compartment 20. In an alternate position of tray 62 as shown in FIG. 9, tray 62 is removed, rotated 180° from the position shown in FIG. 8 and placed back on support frame 44 with longitudinal end 68 now being towards the front. In this position with longitudinal end 70 towards the rear, leg 84 seats on the top of inverted short leg 54*a* of back cross bar 54 thereby elevating the rear of tray 62 causing bottom 64 to be inclined towards the rear. Rim 76 seats on the top of the long leg 56*b* of front cross bar 56 as shown. In this position also, pairs of blades 72 and 74 respectively align and insert in notches 60 to prevent movement of tray 62 in a lateral direction. In this inclined position, tray 62 has advantage as a can 67 dispenser. For example, by setting cans 67, such as soft drink cans, on their sides, they can be inserted into shelf 34 from the front. As each can is loaded, it pushes the previously loaded cans up the incline to the rear in a rolling motion. As cans 67 are removed from the front, the remaining cans 67 roll down the incline to the front where the front can becomes easily accessible as it is stopped by the front raised side 66. Preferably, the width across the front of tray 62 is sufficient to line up two parallel rows of cans 67.

This concludes the description of the preferred embodiment. However, many modifications and alterations will come to mind without departing from the spirit and scope of the invention. For example, shelf 34 could be a conventional flat wire or glass shelf either cantilever or side supported, upon which a tray having a bottom and sides could be placed. The tray could have lateral legs which, in one tray position, could both be supported by the shelf to make the bottom horizontal and, in an alternate tray position, one of the lateral legs could be located where it does not provide support thereby putting the bottom at an incline. Also, the tray could have only one leg at the rear such that if the leg were behind the rear of the shelf, the tray would seat horizontally on the shelf, but, if the leg were supported by the shelf, the tray would be inclined towards the rear. Accordingly, it is intended that the scope of the invention be limited only by the appended claims.

What is claimed is:

1. Food thawing and can dispensing apparatus for a refrigerator, comprising:

a tray having a bottom and raised sides;

means for supporting said tray in a refrigerator; and said tray comprising a downwardly extending lateral leg at one end thereof, said leg being seatable on said supporting means in a first position of said tray with respect to said supporting means for holding said bottom horizontally, said leg further being seatable on said supporting means in a second position of said tray with respect to said supporting means for holding said bottom at an incline wherein, in said second position, said tray is adapted for storing cans rollably disposed towards the front of said refrigerator.

2. The apparatus recited in claim 1 wherein said supporting means comprises a frame suspended cantileverly in said refrigerator.

3. The apparatus recited in claim 1 wherein said tray is reversed in a horizontal plane 180° from said first position to said second position.

4. A refrigerator shelf, comprising:

a substantially rectangular tray comprising a bottom and raised sides;

a frame having a pair of lateral cross members for supporting said tray; and said tray further comprising means engageable with said pair of cross members for holding said bottom of said tray horizontally when a one end of said tray is forwardly in said refrigerator and for holding said bottom of said tray at an incline towards the rear when the opposite end of said tray is forward in said refrigerator.

5. The shelf recited in claim 4 wherein said frame is cantileverly suspended in said refrigerator.

6. The shelf recited in claim 4 wherein said holding means comprises a lateral leg extending downwardly from said one end of said tray.

7. The shelf recited in claim 6 wherein said cross-members are substantially L-shaped with the back cross member being inverted from the front cross member, and wherein said tray is supported by said cross-members.

8. A refrigerator shelf, comprising:

a tray comprising a substantially rectangular bottom panel and a raised peripheral wall;

a frame for supporting said tray, said frame having a pair of parallel cantilever supported side members with front and back cross members connected therebetween; and said tray further comprising means for holding said bottom panel with a rearward incline when one end of said tray is toward the rear and for holding said bottom panel horizontal when said one end is toward the front wherein, when said bottom panel is rearwardly inclined, rollable objects supported by said panel are disposed to roll toward the front of said refrigerator.

9. The shelf recited in claim 8 wherein said front and back cross members are substantially L-shaped with said back cross member being inverted from said front cross member.

10. A refrigerator shelf, comprising:

a tray comprising a substantially rectangular bottom panel having a raised peripheral wall with a lip;

a frame for supporting said tray, said frame having a pair of parallel side members adapted for being cantilever-supported in said refrigerator, said frame further comprising a substantially L-shaped front cross member and a substantially inverted L-shaped back cross member interconnected between said parallel side members; and said tray further comprising a leg extending downwardly from said lip on one side of said tray wherein when said leg side of said tray is at the rear of said refrigerator, said leg engages the top of said back cross member elevating the rear of said tray to provide a rearward incline of said bottom panel and, when said leg side of said tray is toward the front of said refrigerator, said leg seats on the bottom portion of said front cross member thereby supporting said panel in a substantially horizontal position.

* * * * *